United States Patent [19]

Hermann, Sr.

[11] Patent Number: 4,631,906

[45] Date of Patent: Dec. 30, 1986

[54] BRIDLE ARRANGEMENT FOR A HORSE OR LIKE ANIMAL

[76] Inventor: Rudolph J. Hermann, Sr., 250 Stoney Creek Rd., Lake Orion, Mich. 48035

[21] Appl. No.: 735,375

[22] Filed: May 17, 1985

[51] Int. Cl.[4] ..... B68B 1/04

[52] U.S. Cl. ..... 54/8

[58] Field of Search ..... 54/6 R, 6 A, 7, 8, 9, 54/15

[56] References Cited

U.S. PATENT DOCUMENTS

| | | | |
|---|---|---|---|
| 319,897 | 6/1885 | French | 54/8 |
| 612,440 | 10/1898 | Shepard | 54/8 X |
| 892,748 | 7/1908 | Lawton | 54/9 |
| 1,012,464 | 12/1911 | Smith | 54/9 |
| 1,291,243 | 1/1919 | Swales . | |
| 1,368,704 | 2/1921 | De La Mota . | |
| 2,512,244 | 6/1950 | DeWolfe | 54/6 |
| 3,750,368 | 8/1973 | Hyland | 54/8 |

*Primary Examiner*—Robert P. Swiatek

*Attorney, Agent, or Firm*—Gifford, Groh, VanOphem, Sheridan, Sprinkle & Dolgorukov

[57] ABSTRACT

A bridle arrangement for a horse or like animal to control the animal's movement and behavior generally include a headstrap for maintaining the bridle arrangement in its proper position and a pair of mouth-pieces connected to the headstrap and disposed within the corners of the animal's mouth. The mouth-pieces comprise a planar body having a flange extending outwardly therefrom to which a snaffle ring and the control reins are connected. Disposed on the inwardly disposed face of the planar body is a tubular member having a rectangular throughbore extending parallel to the planar body and through which the headstrap is secured. Extending from one end of the tubular member is an elongated tongue which is generally U-shaped such that the remote second end of the tongue is parallel to the planar body and the first end of the tongue. The second end of the elongated tongue extends into the animal's mouth when the mouth-piece is in place.

12 Claims, 3 Drawing Figures

BRIDLE ARRANGEMENT FOR A HORSE OR LIKE ANIMAL

BACKGROUND OF THE INVENTION

I. Field of the Invention

This invention relates to a bridle arrangement utilized to control the movements of a horse or similar animal and, in particular, to a bridle which eliminates the cross-bit manually included as a part of a bridle by incorporating a pair of identical mouth-pieces which extend into the animal's mouth but not across it to control the animal's movement.

II. Description of the Prior Art

Conventional bridle arrangements have utilized a cross or bar bit to control the movements of a horse or similar animal. The cross bit generally extends across the animal's mouth near the corners of the mouth. Secured to both ends of the bar bit are snaffle rings and the control reins which allow the rider to control or direct the animal. In addition, the bar bit and snaffle rings are connected to a headstrap arrangement which maintains the bit in its proper position.

Because of the foreign nature of the bar bit, the animal has a tendency to put its tongue over the bit so that the bit is under its tongue as opposed to its proper position on top of the tongue. Any pull on the control reins when the bit is under the animal's tongue will cause irritation or pain thereby making the animal difficult to control. This is especially true in the case of a pony or similar young animal being ridden by a child wherein a pull on the reins may cause the animal to become temperamental and unsafe for riding. To overcome this problem, devices have been developed to prevent the animal from placing its tongue over the bar bit.

The most common tongue guard is in the nature of a U-shaped rearward projection which can be attached to the bar bit or formed as an integral part thereof. These make it difficult for the animal to place its tongue over the bit. However, because the control reins of the bridle are connected to the ends of the bar bit, any pull on the reins will cause bits having these various known tongue guards to exert sudden abnormal pressure on the animal's tongue and mouth.

In order to further limit the irritation caused by these previously known tongue guards which were attached to the bar bit, a tongue guard which was disposed separate from the bar bit has been developed. These separate tongue guards are secured to the headstrap by additional strap means but are not connected to the bar bit or the control reins thereby reducing irritation as caused by the tongue guard when the reins are pulled. These separate tongue guards generally comprise a cross member which spans the animal's mouth behind the bar bit. However, although the separate tongue guards eliminate some of the irritation, some pressure is still exerted when the reins are pulled. Moreover, the tongue control does not eliminate the general irritation caused to the animal by the foreign nature of the cross members which span the animal's mouth.

SUMMARY OF THE PRESENT INVENTION

The present invention overcomes the disadvantages of the prior art by providing a bridle arrangement for a horse or similar animal which eliminates the cross bit while allowing full control of the animal by the rider.

The bridle arrangement according to the present invention comprises a headstrap system to secure the bridle in its proper position, and a pair of mouth-pieces detachably secured to the headstrap. The headstrap system is of a conventional type which passes over the top of the animal's head and generally includes a noseband, cheek straps and headstall. The headstrap system may also include a throatlatch, a front strap, and any other strap means necessary to maintain the position of the bridle. The cheek straps are detachable secured to a pair of mouth-pieces one of which is disposed on each side of the animal's mouth. A portion of each mouth-piece extends into the mouth of the animal to provide proper control of the animal as will be described hereinafter.

The mouth-pieces are identical to each other and comprise a planar body having a flange extending from the outer face and a tubular member secured to the inner face thereof. The tubular member has a generally rectangular cross-section and defines a rectangular throughbore. The axis of the throughbore is parallel to the planar body. Extending from the innermost wall of the tubular member is an elongated tongue having a first and a second planar portion which are parallel to each other and to the planar body. Moreover, the first and second portions of the tongue are spaced apart from each other but are connected by an intermediate curved portion.

The mouth-pieces are utilized to maintain control of the animal and are positioned such that the elongated tongue extends around the corner of the animal's mouth. A snaffle ring is disposed through an opening in the flange to which the control reins are connected. Thus, to direct the animal, the reins may be pulled which exerts a corresponding pressure on the corner of the animal's mouth. Unless the reins are pulled the animal suffers no discomfort. With this arrangement the cross bit is eliminated thereby reducing the continuous discomfort to the animal caused by a bit extending across the animal's mouth.

BRIEF DESCRIPTION OF THE DRAWING

The present invention will be more fully understood by reference to the following detailed description of the preferred embodiment of the present invention when read in conjunction with the accompanying drawing, in which like reference characters refer to like parts throughout the views and in which.

DETAILED DESCRIPTION OF THE PREFERRED EMBODIMENT OF THE PRESENT INVENTION

Figure 1:
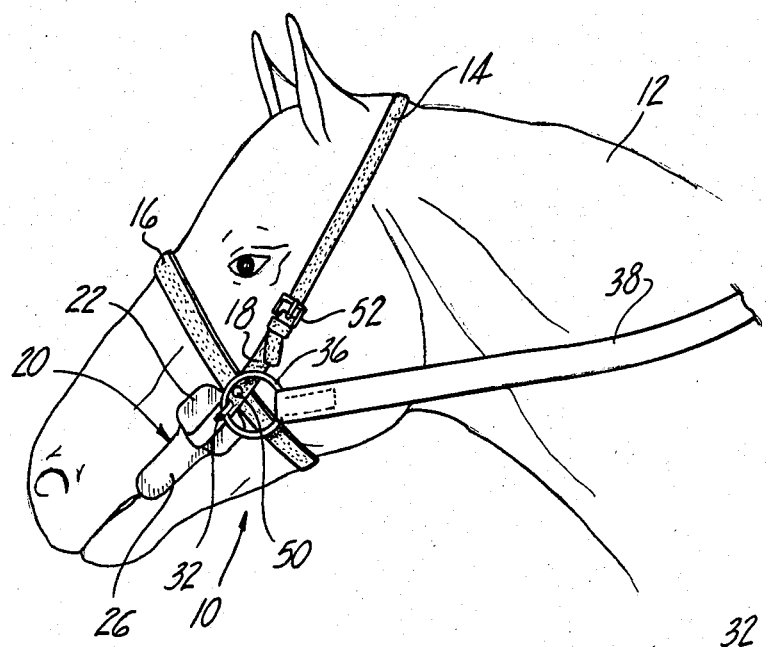
FIG. 1 is a perspective view of the head of a horse wearing the bridle arrangement in accordance with the preferred embodiment of the present invention.

Referring generally to FIG. 1, a bridle arrangement 10 embodying the present invention is thereshown mounted to the head of a horse or similar animal 12. The bridle arrangement 10 is utilized to control the animal 12 while riding or leading the animal 12. The bridle arrangement 10 of the present invention generally comprises conventional bridle components including a headstall 14, a noseband 16, and cheek straps 18. These bridle components maintain the bridle arrangement 10 in its proper position on the animal's head. However, it is to be understood that the components of the bridle arrangement 10 may vary according to riding requirements.

In the preferred arrangement shown in FIG. 1, the cheek straps 18 are detachably secured to the headstall 14 to facilitate removal of the bridle 10. The noseband 16 is secured to the cheek straps 18 such that the bridle 10 can be easily positioned or removed simply by placing the bridle 10 over the animal's nose.

Figure 3:
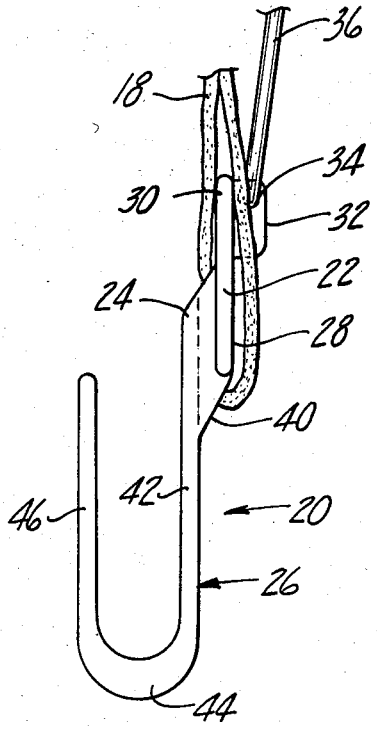
FIG. 3 is a side elevational view of the present invention shown with the headstrap for clarity.

As is best shown in FIGS. 1 and 3, the cheek straps 18 are each secured to a mouth-piece 20. A pair of mouth-pieces 20 are therefore utilized in the bridle arrangement 10 of the present invention to control the animal 12 while eliminating the cross bit of a conventional bridle arrangement. One mouth-piece 20 is placed in each corner of the animal's mouth and generally comprises a planar body 22, a tubular member 24, and an elongated tongue 26. In the preferred embodiment, the components of the mouth-piece 20 are integrally formed of a non-corrosive metal to prevent rusting and corrosion while in the animal's mouth but may also be molded of plastic or similar material.

Figure 2:
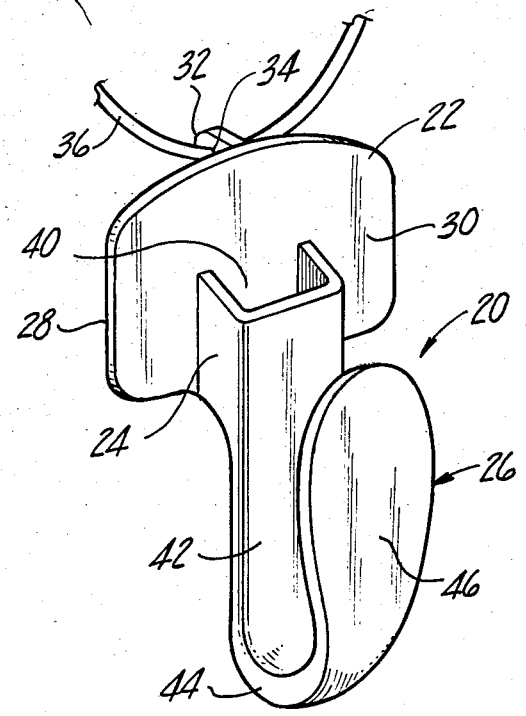
FIG. 2 is an elevated perspective of the mouth-piece embodying the present invention.

Referring now to FIGS. 2 and 3, the mouth-pieces 20 preferably comprise a planar body 22 having an outwardly disposed face 28 and an inwardly disposed face 30. When the mouth-piece 20 is in its proper position (FIG. 1), outer face 28 is disposed away from the animal 12 and inner face 30 is disposed towards the animal 12. In the preferred embodiment, the planar body 22 of the mouth-piece 20 has a substantially rectangular shape. However, alternatively the planar body 22 may have any shape which would prevent the mouth-piece from passing into the animal's mouth, including round or elliptical.

Extending perpendicularly to the outer face 28 of the planar body 22 is a flange member 32. The flange member 32 is preferably rectangular and has an aperture 34 extending through the side of the flange 32. The aperture 34 is just large enough to accept and allow free movement of a snaffle ring 36. The snaffle ring 36 is of a conventional type found on standard bridle arrangements. The snaffle ring 36 is secured to the control reins 38 which allow the rider (not shown) to control and direct the animal 12. By pulling on the reins 38, the speed and direction of the animal can be controlled as will be subsequently described.

Integrally formed to the inner face 30 of the planar body 22 is tubular member 24. Tubular member 24 preferably has a rectangular cross-section and defines a rectangular throughbore 40. The tubular member 24 and throughbore 40 are of sufficient size to accept the cheek straps 18 therethrough. The cheek straps 18 detachably secure the mouth-piece 20 to the bridge arrangement as will be described herein. Preferably, inner face 30 of the planar body 22 forms one side of the tubular member 24 and the elongated tongue 26 forms the opposing side thereby minimizing the size and weight of the mouth-piece 20.

Referring still to FIGS. 2 and 3, the elongated tongue 26 extends from one end of the innermost wall of the tubular member 24 and has a U-shape as viewed from one side of the mouth-piece 20. The tongue 26 comprises a first planar portion 42, which extends from the innermost wall of tubular member 24 parallel to the planar body 22, an intermediate arcuate portion 44 which curves inwardly away from the planar body 22, and a second planar portion 46 which is disposed in a spaced parallel arrangement to the first planar portion 42. Both the first portion 42 and the arcuate portion 44 have straight parallel sides while second portion 46 has flared edges whereby second portion 46 has a substantially oval shape as shown in FIG. 2.

Operation of the mouth-piece 20 requires that it first be secured to the bridle arrangement 10 in order to maintain proper positioning. The cheek strap 18 is attached to the mouth-piece 20 by passing the strap 18 through the rectangular bore 40. Because of its shape, the bore 40 closely conforms to the strap 18 but allows sufficient movement therethrough. After passing the strap 18 through the bore 40, it is then passed back across the outer face 28 of the planar body 22. Thus, the cheek strap 18 passes across the inner face 30 of planar body 22, through the tubular member 24 and back across the outer face 28 of the planar body 22. Thereafter, the two free ends of the strap 18 may be permanently secured together by a rivet 50 or similar means. Alternatively, the free ends of the strap 18 can be detachably secured directly to the bridle arrangement so that the cheek strap 18 may be removed from the mouth-piece 20 in the event replacement of either the strap 18 or mouth-piece 20 is necessary. In addition to the securing means 50, the cheek strap 18 is provided with a slit or opening through which the flange member 32 passes. Once the strap 18 is in place with the flange 32 passing through the strap 18, the snaffle ring 36 is placed through the aperture 34 of the flange 32 to further secure the mouth-piece 20 to the cheek strap 18. Therefore, the mouth-piece 20 may be detachably secured to the cheek strap 18 by buckle means 52 or, alternatively, the mouth-piece 20 may be permanently secured to the cheek strap 18 by either the rivet means 50 or the flange 32 and snaffle ring 36, or both.

Once the mouth-piece 20 is secured to the cheek strap 18, the device may be positioned on the animal 12. After attaching the cheek strap 18 and mouth-piece 20 to the remaining bridle components, particularly the headstall 14 and noseband 16, the entire bridle arrangement 10 is mounted to the animal's head. Since the bridle arrangement 10 comprises a pair of mouth-pieces 20, one mouth-piece 20 is placed in each side of the animal's mouth. The mouth-piece 20 is positioned by placing the second portion 46 of the tongue 26 into the animal's mouth such that the arcuate portion 44 extends around the corner of the animal's mouth. Thus, first portion 42 of the tongue 26 is disposed exteriorly of the animal's cheek and the second portion 46 is disposed interiorly of the cheek with the arcuate portion 44 extending around the corner of the animal's mouth. Once in place, the entire bridle arrangement 10 is securely positioned in order to maintain proper alignment and to prevent the animal 12 from removing the mouth-piece 20 from it's mouth with its tongue or otherwise.

In use, because the mouth-piece 20 securely engages the corners of the animal's mouth and the control reins 38 are attached to the mouth-pieces, any pull or tug on the reins 38 will exert a corresponding pressure on the corner of the animal's mouth. As with conventional bridle arrangements, the animal 12 is trained to respond to the pressure exerted by the reins 38. However, unlike the conventional bridle arrangements, the present invention eliminates the bar or cross bit which can irritate the tongue and inner mouth cavity of the animal after extensive use. Thus, the present invention provides a more humane means of controlling a horse or like animal by eliminating the cross-bit but maintains sufficient control of the animal 12 by the rider.

The foregoing detailed description has been given for clearness of understanding only and no unnecessary limitations should be understood therefrom as some modifications will be obvious to those skilled in the art to which it pertains without deviation from the spirit of the invention as defined by the scope of the appended claims.

I claim:

1. A bridle arrangement for a horse or like animal comprising a pair of mouth-pieces extending within the corners of the animal's mouth, each of said pair of mouth-pieces having a planar body having an outer face and an inner face;

a tubular member secured to said inner face of said planar body wherein said tubular member defines a throughbore;

an elongated tongue extending from said tubular member wherein said elongated tongue is substantially U-shaped;

a flange extending perpendicularly to said outer face of said planar body, said flange having an aperture therethrough;

strap means connected to said pair of mouth-pieces for mounting said bridle arrangement on the animal's head to position and maintain said pair of mouth-pieces within the animal's mouth;

a pair of snaffle rings detachably connected to said pair of mouth-pieces; and control rein means connected to said snaffle rings for exerting pressure on said mouth-pieces to control the animal's movement.

2. The invention as defined in claim 1 wherein said elongated tongue comprises a first and a second planar portion disposed parallel to said planar body, said first and second portions disposed in a spaced parallel arrangement, and an intermediate arcuate portion connecting said first and second parallel portions.

3. The invention as defined in claim 2 wherein the edges of said second planar portion of said elongated tongue are flared outwardly whereby said second planar portion is substantially oval shaped.

4. The invention as defined in claim 1 wherein said flange aperture accepts a snaffle ring.

5. The invention as defined in claim 1 wherein said tubular member has a rectangular cross-section and wherein said throughbore is substantially rectangular in cross-section.

6. The invention as defined in claim 5 wherein said elongated tongue is an extension of the innermost wall of said tubular member.

7. The invention as defined in claim 1 wherein said planar body, said flange, said cylindrical member and said elongated tongue are integrally formed.

8. The invention as defined in claim 1 wherein said mouth-pieces are constructed of a non-corrosive metal.

9. The invention as defined in claim 1 wherein said mouth-pieces are detachably connected to said bridle arrangement.

10. The invention as defined in claim 1 wherein said strap means comprises cheek straps, a noseband, and a headstall.

11. The invention as defined in claim 10 wherein said cheek straps extend through each of said throughbore and wherein said cheek straps extend around each of said planar bodies across said outer and inner faces.

12. The bridle arrangement as defined in claim 11 wherein each flange extends through an opening in said cheek strap whereby said cheek strap is disposed between said planar body and one of said pair of snaffle rings thereby securing said mouth-piece in position on said bridle arrangement.

* * * * *